United States Patent [19]

Ford

[11] Patent Number: 4,738,129

[45] Date of Patent: Apr. 19, 1988

[54] STEEL BATHTUB AND FORMING METHOD

[75] Inventor: Kenneth D. Ford, Connersville, Ind.

[73] Assignee: Bootz Manufacturing Co., Inc., Evansville, Ind.

[21] Appl. No.: 905,557

[22] Filed: Sep. 10, 1986

[51] Int. Cl.[4] ..... B21D 22/21; B21D 22/26; B21D 22/30; B21D 24/16

[52] U.S. Cl. ..... 72/348; 72/350; 4/538

[58] Field of Search ..... 72/347, 348, 350, 351; 4/538, 546, 591; D23/55

[56] References Cited

U.S. PATENT DOCUMENTS

| | | | |
|---|---|---|---|
| D. 216,119 | 11/1969 | Kaiser | D23/55 |
| D. 250,962 | 1/1979 | Bonsack | D23/55 |
| D. 271,995 | 12/1983 | Topete | D23/55 |
| D. 274,456 | 6/1984 | Cuttriss | D23/55 |
| D. 287,397 | 12/1986 | Cuttriss | D23/55 |
| 1,033,209 | 7/1912 | Stucki | 72/348 |
| 2,231,345 | 2/1941 | Potchen | 156/224 |
| 2,325,369 | 7/1943 | Chesney | 72/350 |
| 3,344,646 | 10/1967 | Moller | 72/348 |

FOREIGN PATENT DOCUMENTS

| | | | |
|---|---|---|---|
| 1115694 | 10/1961 | Fed. Rep. of Germany | 72/347 |
| 2913253 | 11/1980 | Fed. Rep. of Germany | 72/347 |
| 17330 | 1/1982 | Japan | 72/350 |
| 61530 | 4/1984 | Japan | 72/347 |
| 2038177 | of 0000 | United Kingdom | 4/538 |
| 614852 | 7/1978 | U.S.S.R. | 72/347 |

*Primary Examiner*—Lowell A. Larson
*Attorney, Agent, or Firm*—Woodard, Emhardt, Naughton Moriarty & McNett

[57] ABSTRACT

This invention relates to a method of forming a bathtub having a sloped back end in a sheet steel drawing process, wherein a steel blank is first held onto a draw ring and bed by a blank holder. A punch in the general shape of the bathtub is forced into the blank. As the punch extends into the draw ring, an air draw is made at the portion of the blank corresponding to the sloped back end in the final product of the process. This portion of the blank develops wrinkles as the drawing operation continues, until the blank contacts a die in the bed of the set-up. As the punch extends further into the draw stroke the blank is pressed into recesses in the die by corresponding bulges in the punch, thereby "ironing" out the wrinkles in the blank so that the sloped end is smooth.

6 Claims, 7 Drawing Sheets

STEEL BATHTUB AND FORMING METHOD

BACKGROUND OF THE INVENTION

1. Field of the Invention

This invention relates generally to bathtubs and to the manufacture of bathtubs, and more particularly to a steel bathtub having a sloped end for use as a back-rest.

Modern bathtubs are typically made in three types of media, namely: cast iron, drawn steel, and molded plastic. Bathtubs are typically made in lengths of 4 ft., 4½ ft. and 5 ft. The 5 ft. length is probably the most typical.

For those who like to sit and soak in a bathtub, it is desirable for the bathtub to have a sloped back end. The present process description refers to this as an "incline end" bathtub. The "incline end" bathtub typically has a slightly inclined bottom, and a front end wall and two side walls that are substantially vertical, while the back end wall is inclined at a gradual angle. This shape is easy to produce in plastic or cast iron. This shape is not easy to produce in a sheet steel drawing operation, however, because the nature of the draw at the back end is so different from the draw around the front and sides.

A principal problem encountered in forming such a steel bathtub with a sloped back end is that the back end material naturally tends to wrinkle as the steel sheet is drawn. The present invention is directed to solving this problem in the manufacture of "incline end" bathtubs.

2. Description of the Related Art

The closest prior art in the form of U.S. patents which has been discovered is as follows:

| U.S. Pat. No. | Inventor | Issue Date |
|---|---|---|
| 3,438,111 | Wilcox | Apr. 15, 1969 |
| 3,496,896 | Smith | Feb. 24, 1970 |
| 3,543,559 | Hawkins et al. | Dec. 1, 1970 |
| 4,357,816 | Antonov et al. | Nov. 9, 1982 |
| 4,470,287 | Antonov et al. | Sep. 11, 1984 |

The Smith U.S. Pat. No. 3,496,896 discloses a method of making a foil pan using a punch and die wherein the punch and die each have a cavity area. As the pan is formed from a blank, circumferentially spaced corrugations form in the side wall of the pan as a natural consequence of the drawing and stamping process. The cavities in the punch and die permit these corrugations to form without restriction.

In the Wilcox U.S. Pat. No. 3,438,111, a method of making a wheel rim from sheet stock comprises a series of drawing and stamping operations to produce a contoured article with varying wall thickness. In one step of the process, a circumferential recess is formed prior to ironing the blank into a radial flange.

A method described in the Hawkins U.S. Pat. No. 3,543,559 uses a specially formed die with spaced grooves to take advantage of the buckling of the sheet stock as it is drawn in the stamping process. The die grooves accommodate the buckled material to form corrugation ribs in the stamped article.

The Antonov U.S. Pat. No. 4,470,287 defines a method for producing hollow articles by deep drawing.

No prior art was discovered that described a process for drawing a bathtub from sheet steel where the bathtub has a sloped back end.

SUMMARY OF THE INVENTION

Described briefly, according to a typical embodiment of the present invention, a method of making a steel bathtub having a sloped back end comprises the first steps of holding a steel blank against a draw ring. A press is used to force a punch into the blank such that three sides of the punch are in contact with the blank during the drawing operation, while a fourth side, corresponding to the sloped back end of the bathtub, is not in contact with the blank during most of the stroke of the press, and contacts just prior to reaching the bottom of the stroke. In the final steps of the method, the blank contacts a die at the fourth side and the punch is further forced into the blank to draw the blank into the die, thereupon removing any wrinkles that formed in the sloped back end during the drawing process.

DESCRIPTION OF THE PREFERRED EMBODIMENT

Figure 1:
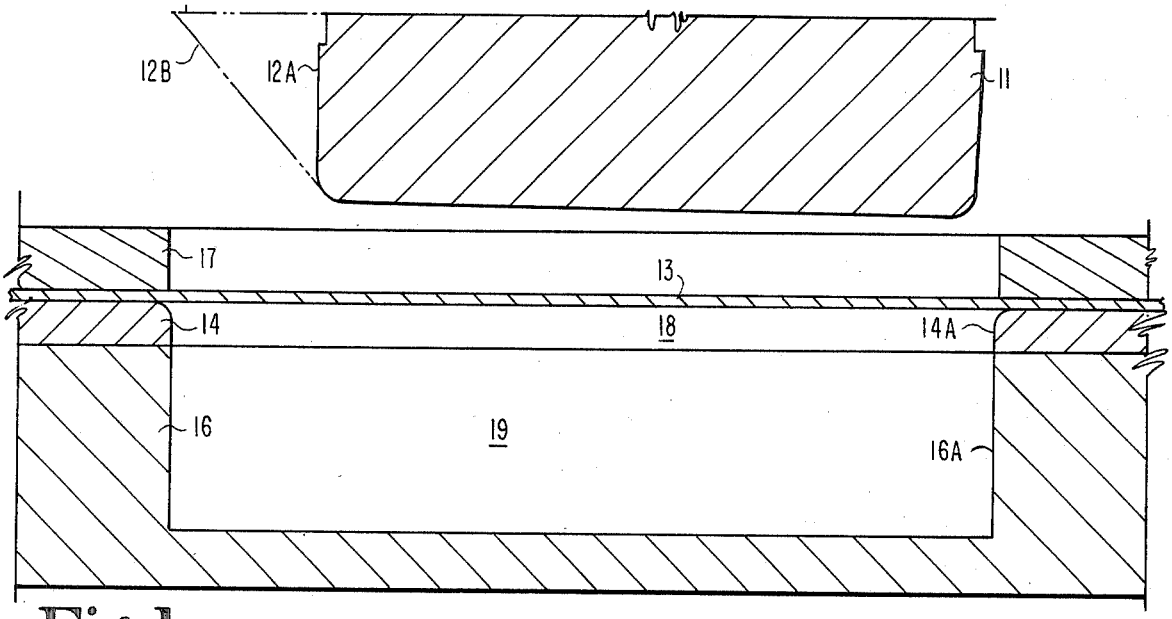
Fig.1 PRIOR ART
FIG. 1 is a longitudinal sectional view of a typical set-up for a sheet metal drawing operation in which one side of the final product is to be sloped.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a longitudinal sectional view of a typical set-up wherein a very large press of the Baldwin type includes the ram or punch 11 having the desired shape of a substantial portion of the interior of the bathtub. The sloped back end can be formed using a punch having a vertical segment 12A or a sloped segment 12B, shown in phantom, at the back end of the punch, so that the sloped back end of the bathtub may be formed with or without contact with the punch surface during the drawing operation. The wrinkling problem addressed below can arise even with the punch configured as at segment 12B. The sheet steel blank 13 rests on top of the draw ring 14 which is secured to the bed 16. In each of the figures, for purposes of clarity, the thickness of the blank 13 has been exaggerated relative to the remaining elements of the disclosed invention. The blank holder 17 holds the perimeter of the sheet steel blank against the draw ring with the desired force. The amount of gripping force applied at various locations around the aperture 18 in the draw ring is based upon the experience of the press operator in doing deep draws of this type in steel for bathtubs. It should be noted that, a simplified illustration and description of the draw press has been presented within the present application. It is understood, however, that the typical draw press consists of a bolster and a spacer, riser, or adaptor placed within the bed to support the draw ring and any form die, and that the blank holder is itself backed up by spacers, risers, or adaptors upon which ram pressure adjusting screws act to adjust the blank holding pressure and drawing pressure. In such a draw press, a total of 600 tons can be exerted on the blank holder.

Figure 2:
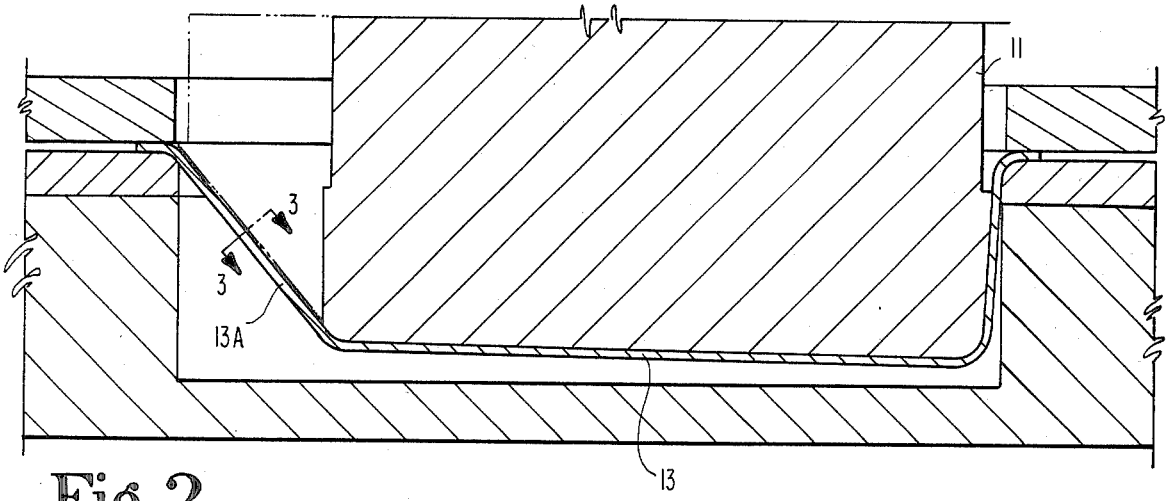
Fig.2 PRIOR ART
FIG. 2 is a longitudinal sectional view of the set-up of FIG. 1 showing the punch at the final draw depth.
Figure 3:
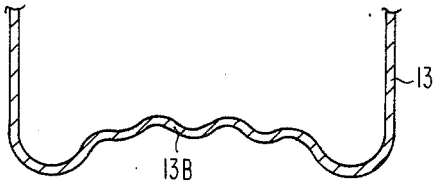
Fig.3 PRIOR ART
FIG. 3 is a cross-sectional view taken at line 3—3 in FIG. 2 and viewed in the direction of the arrows showing wrinkles in the sloped side.

The problem in a draw of this nature is that the sloped back end 13A (FIG. 2) is formed in air and is not supported on either of its surfaces by the punch or die. While the punch is descending to a position as shown in FIG. 2, a good draw is made around the bottom, front end and sides of the punch as the blank conforms to the shape of the punch. However, the sheet metal at the back end 13A buckles or becomes wrinkled, as shown in cross section at 13B in FIG. 3, because it does not have any significant area in contact with the punch. This wrinkling is a well-known phenomenon in drawing and stamping processes. The presence of these wrinkles would render the inclined end of the bathtub unusable for its intended purpose.

The present invention provides a method to eliminate the wrinkles that typically arise as the sloped back end is formed in the "incline end" bathtub. The method contemplated herein is part of the normal procedure for the fabrication of a sheet metal bathtub that consists, typically, of drawing the sump or basin, piercing the drain 36 (FIG. 11), embossing the apron 39 (FIG. 9), forming the horizontal perimetrical flange 37 (FIG. 11) and the vertical tile flanges 38 (FIG. 10), wiping the apron down into its final position and piercing the overflow orifice (omitted in the figures to simplify the illustrations). The method of this invention concerns the step in the fabrication process of drawing the bathtub sump.

Figure 4:
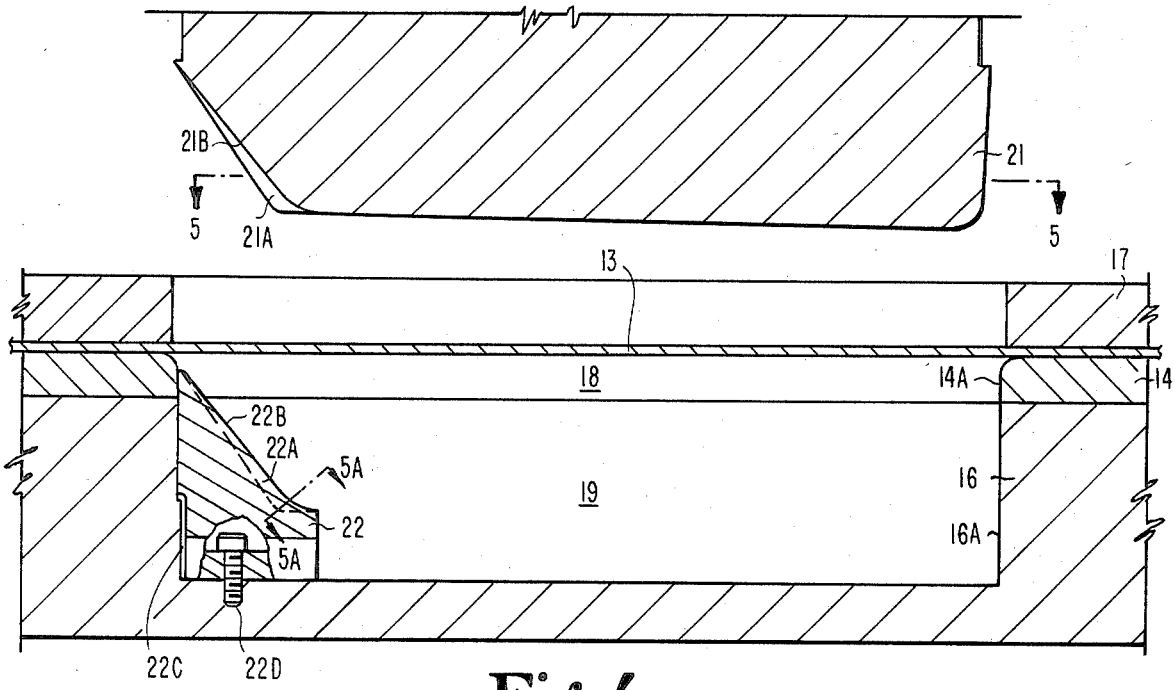
FIG. 4 is a longitudinal sectional view of set-up for drawing a sheet steel bathtub in the preferred embodiment of the present invention.
Figure 5:
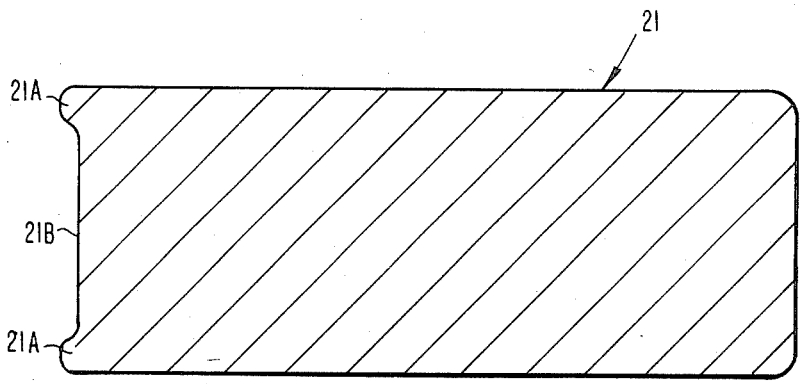
FIG. 5 is a sectional view of the punch taken at line 5—5 in FIG. 4 viewed in the direction of the arrows.
Figure 5A:
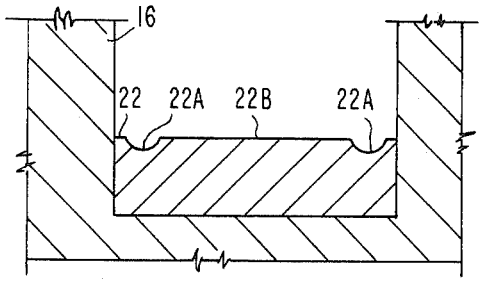
FIG. 5A is a sectional view of the die taken at line 5A—5A in FIG. 4 viewed in the direction of the arrows.
Figure 6:
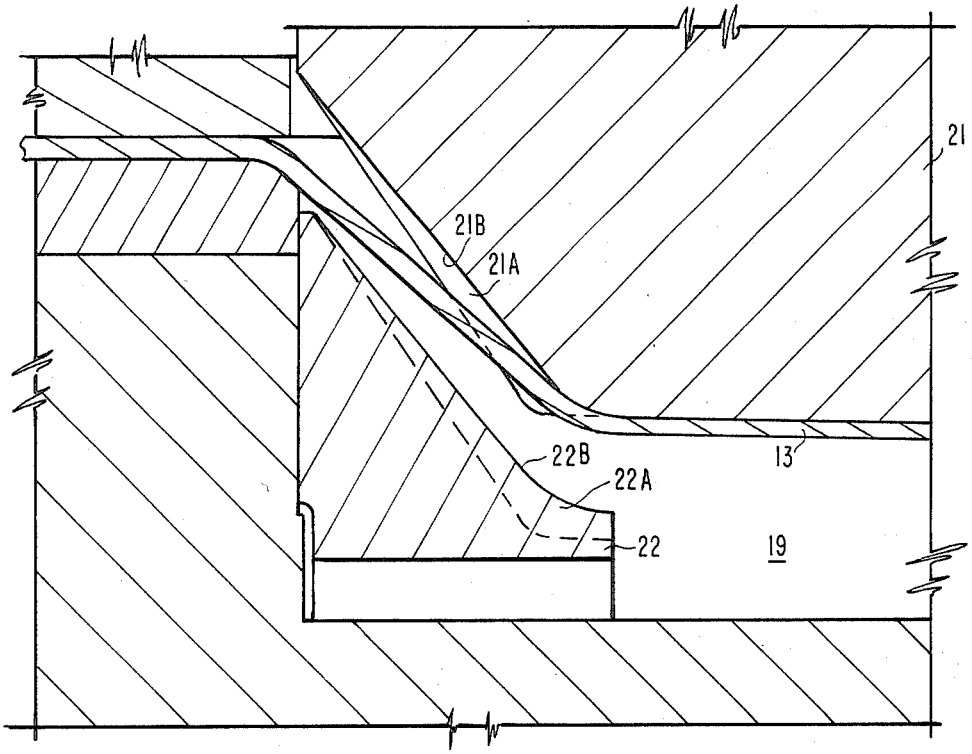
FIG. 6 is an enlarged fragmentary longitudinal sectional view of a portion of the set-up in FIG. 4 showing the punch partially extended in the draw.

As shown in FIG. 4, a punch 21 and a bottom form block or die 22 are used to draw the blank 13 into its final shape. According to the invention, the punch 21 is provided with bulges 21A, situated as shown in the cross-sectional view of the punch in FIG. 5 taken at the location where the effective radius of the bulges is the greatest. The die 22 is provided with matching cavities 22A (FIG. 5A). The die is held in position within the bed by some suitable fastening means. In this instance, the die is located within the bed by a plurality of spaced keyways 22C, and held in position by socket head cap screws 22D. Referring to the enlarged view in FIG. 6, as the punch draws the blank 13 through the draw ring 14, surplus materials gathers in the area between flat 21B on the punch and sloped surface 22B of the die 22. As the draw progresses deeper into the draw cavity 19, this surplus material manifests itself as wrinkles as at 13B in FIG. 3. The surplus material contacts the die 22 at the sloped surface 22B as the punch 21 nears the bottom of the draw.

Figure 7:
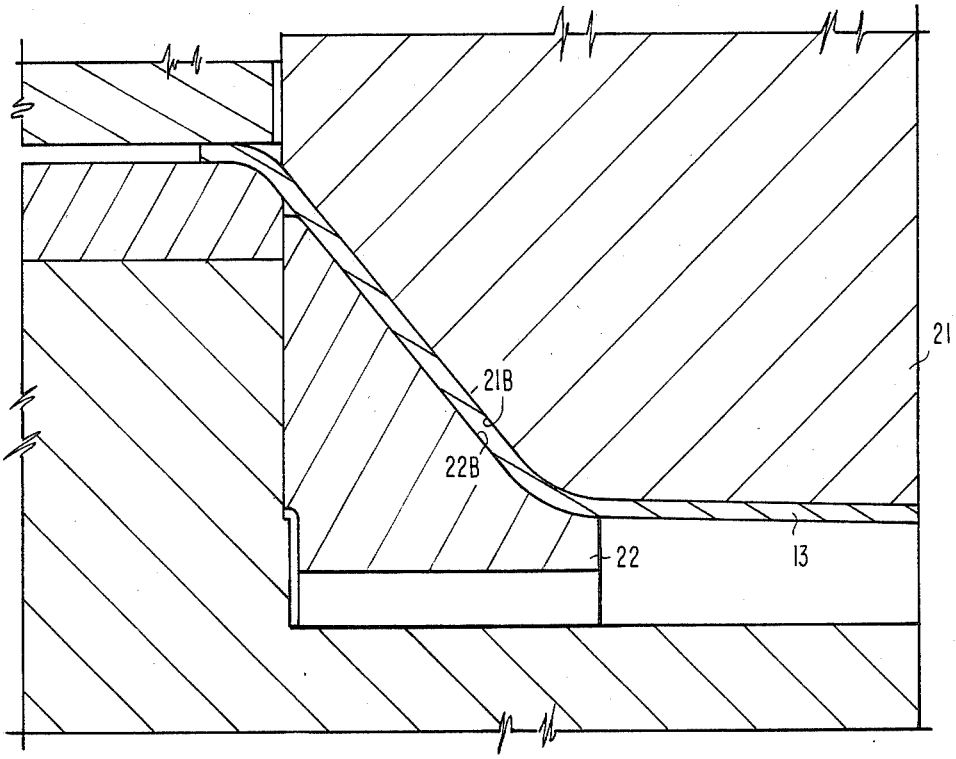
FIG. 7 is an enlarged fragmentary longitudinal sectional view of the set-up in FIG. 4 showing the punch extending to the final draw depth, the section being taken along the centerline of the bathtub.
Figure 8:
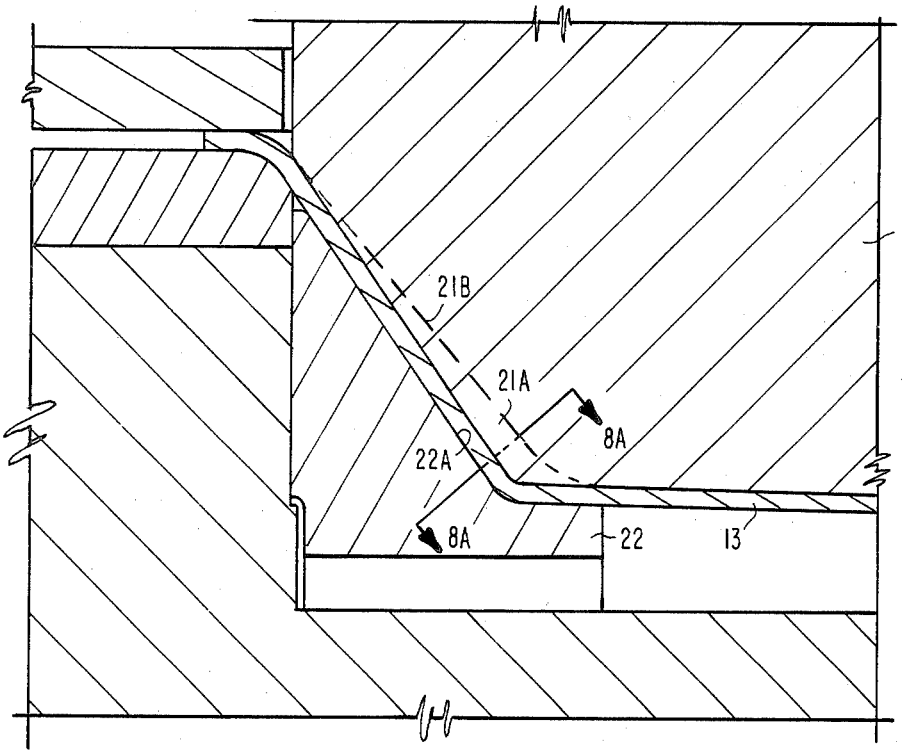
FIG. 8 is an enlarged fragmentary longitudinal sectional view at the same punch-die relationship as in FIG. 7, the section being taken at the location of a swale cavity in the die.
Figure 8A:
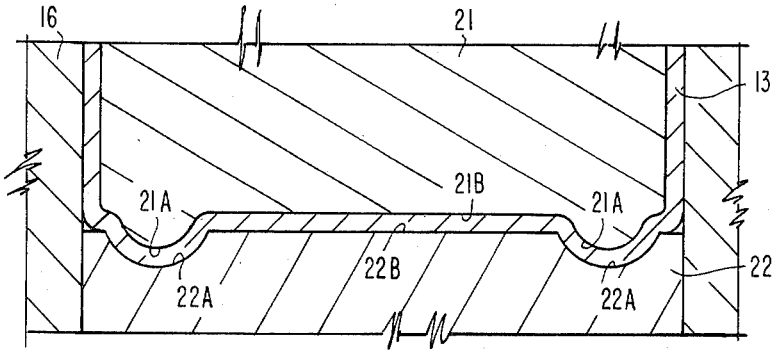
FIG. 8A is a sectional view of the die, punch and blank taken at line 8A—8A in FIG. 8 viewed in the direction of the arrows, showing the swales formed at the end of the draw stroke.
Figure 9:
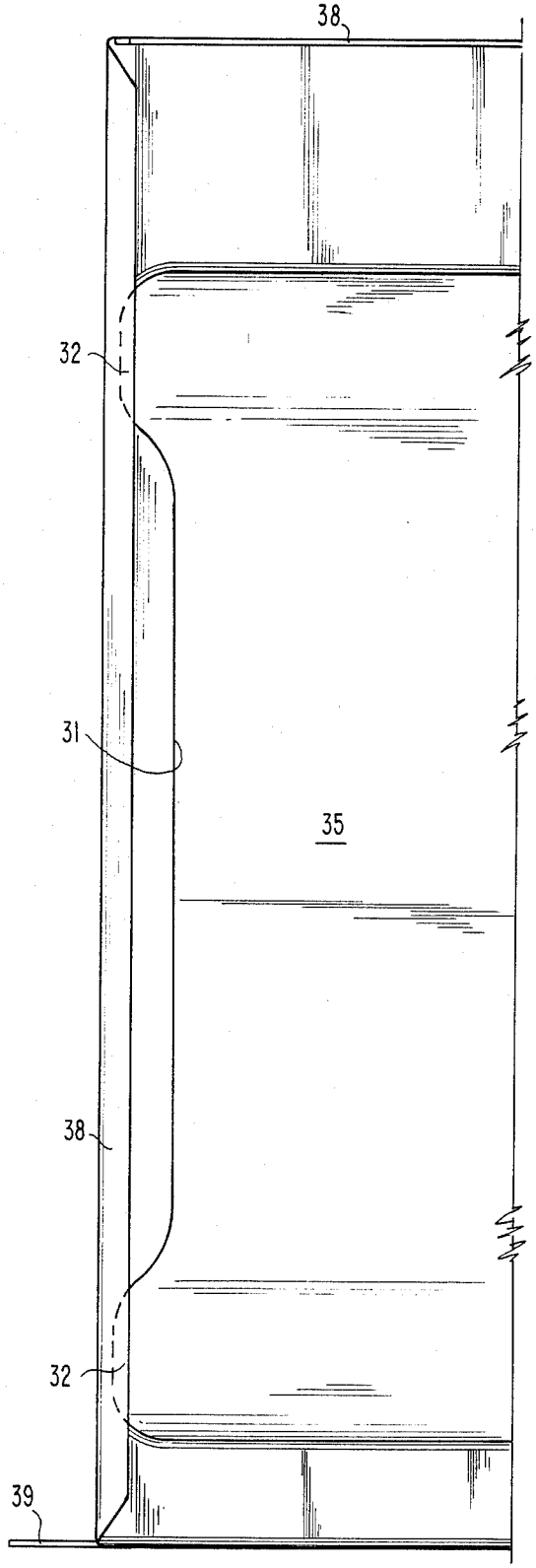
FIG. 9 is a fragmentary top view of an "incline end" bathtub as viewed in the direction of the slope of the sloped back end of the bathtub, or in the direction of the arrows for section 9—9 in FIG. 10.
Figure 10:
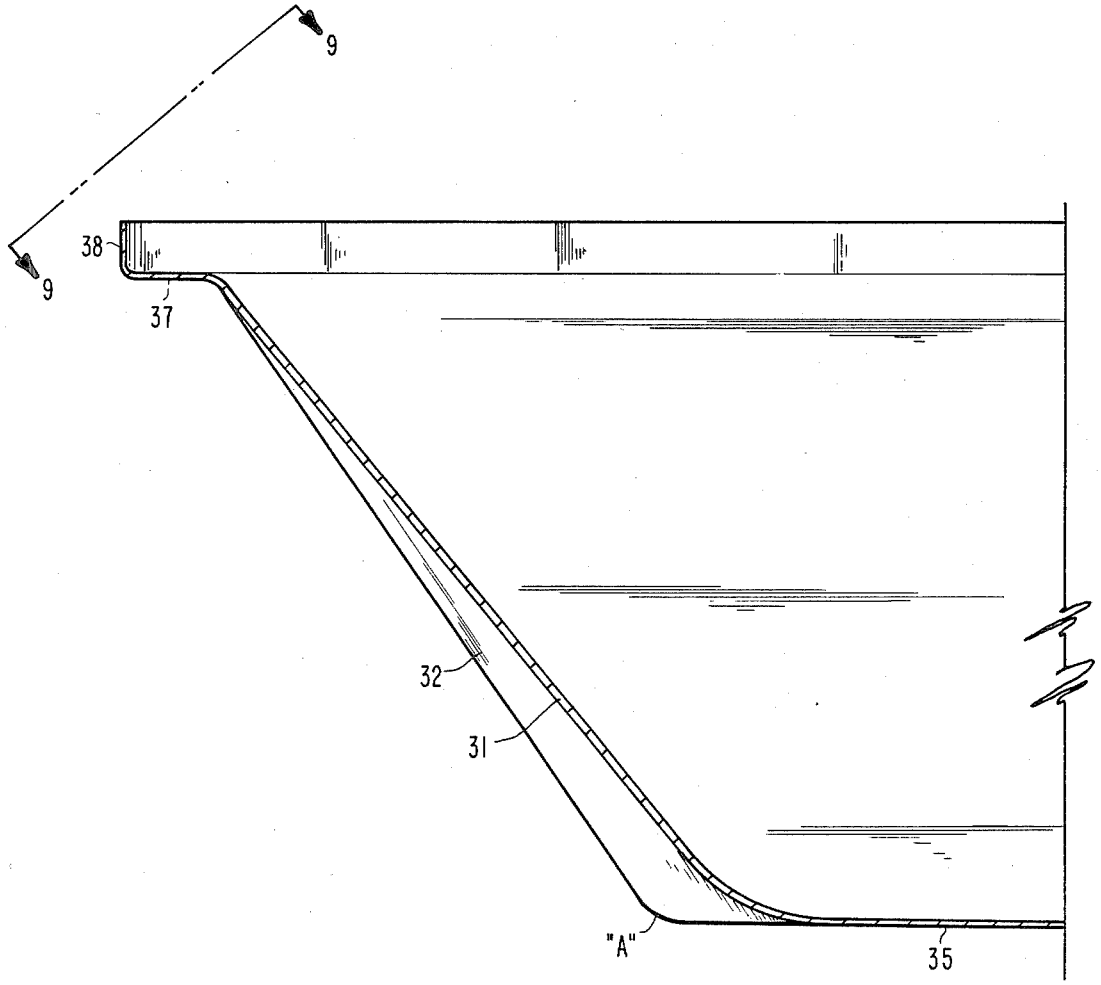
FIG. 10 is a fragmentary longitudinal sectional view of the "incline end" bathtub.
Figure 11:
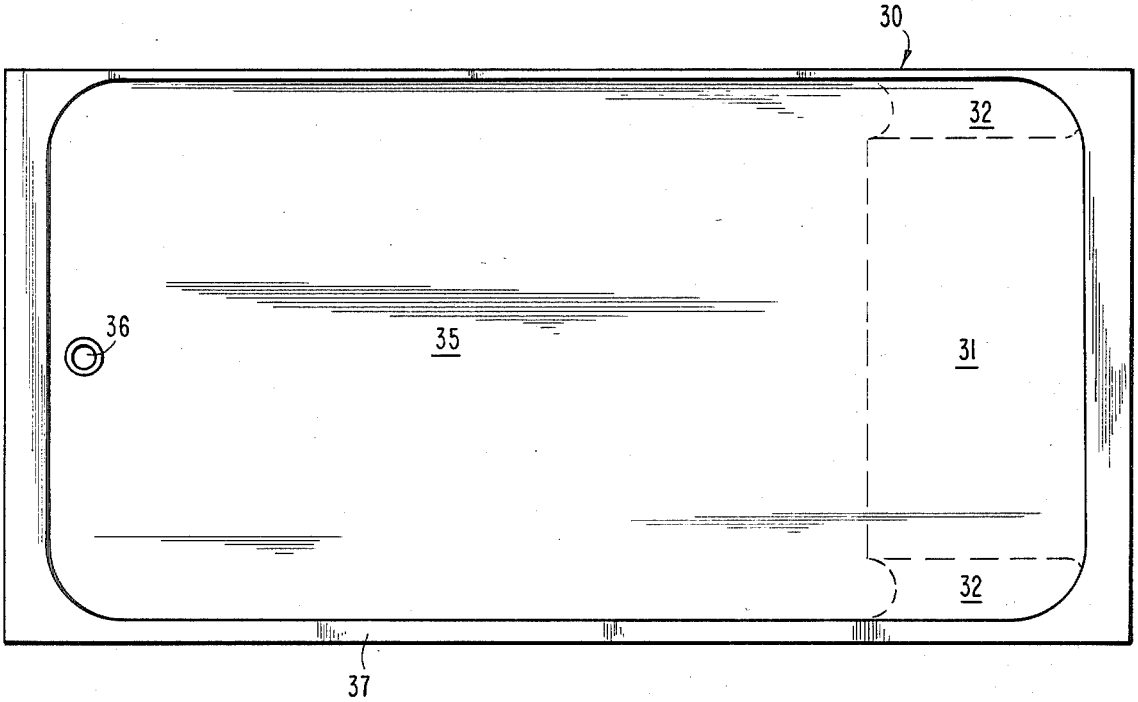
FIG. 11 is a top view of the "incline end" bathtub showing the sloped back end and swales.

Referring now to FIGS. 7 and 8, as the punch descends to the final depth of the draw stroke, the wrinkles are drawn or "ironed" out as the surplus material is pulled out by the bulges 21A into cavities 22A and pressed over flat 22B. FIG. 7 shows the bathtub material flattening action between the flat punch surface 21B and the sloped flat die surface 22B. FIG. 8 shows the bulge 21A holding the bathtub material tight in the swale cavity 22A, the flat 21B being illustrated in phantom lines to emphasize the relation of the swale cavity and punch bulge to the flat. At each of the locations shown in FIGS. 7 and 8, the blank 13 is pressed into the die 22 by the corresponding surface of the punch 21, as illustrated in the sectional view of FIG. 8A. Completion of this process results in the "incline end" of the bathtub, with swales at the end whose shape can be observed when viewed in the direction of the slope as in FIG. 9, being flat at 31 with a swale 32 formed by the bulges 21A and cavities 22A at each side of the flat 31. The "incline end" and swales gradually blend into the bottom 35 of the bathtub (FIG. 10).

In the preferred embodiment of this invention, the back end of the "incline end" bathtub has had an angle of slope of 40° (degrees) from the vertical and 130° (degrees) from the bathtub bottom, although other slope angles are contemplated by this invention. The total draw depth has been approximately thirteen (13) inches. After the punch 21 has entered the draw ring 14 about eight (8) inches, the surplus material begins to gather in the region between the flat 21B and the sloped surface 22B. The wrinkles develop as the punch progresses approximately four (4) additional inches, at which point the surplus material contacts the sloped surface 22B of the die 22. The wrinkles are "ironed out" as the punch descends the final one (1) inch of the draw stroke.

The material used to form this sloped-back bathtub has been drawing quality porcelain enameling sheet steel of 0.059 inch minimum stock thickness. Other material can be substituted that has similar drawing properties. In the final product of this process, the "incline end" bathtub 30 (FIG. 11), the swales 32 are recessed at either side of the sloped back end 31 and are situated to blend into the sides of the bathtub, as illustrated in FIG. 9. In this embodiment, the swales have a gradually increasing recess depth, peaking at a maximum of 1 3/16 inches at location "A" in FIG. 10. Different swale geometries can be created by variations in the geometries of the punch bulges and die cavities. The flat between the swales varies from 12½ inches wide at the top to 11½ inches wide at the bottom. The perimeter of the blank that had been held between the draw ring and the blank holder forms the horizontal surface 37 around the bathtub perimeter and, after subsequent forming, the vertical tile flange 38 about three sides of the bathtub and the apron 39 at one side of the bathtub.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method of making a steel bathtub having a sloped end, comprising the steps of:

placing a steel blank on top of a draw ring;

holding said blank against the draw ring along a marginal portion of said blank;

forcing a punch having four sides into said blank to draw said blank through said draw ring, with three sides of said punch in close contact with the blank as the punch is forced through the plane of the draw ring, while a portion of the blank is not in contact with the punch at the fourth side of said punch so that wrinkles are allowed to form in said portion not in contact as said punch is forced through the draw ring, said wrinkled portion of the blank being formed into a sloped surface as the punch is forced into the blank;

contacting said blank against a form block near the end of the draw, said form block being in complementary relation with said fourth side of said punch and having a sloped surface;

forcing said punch into said blank to further draw said blank into said form block, thereupon removing any wrinkles formed in the portion of the blank not in contact with the punch when the blank was first drawn into the draw ring;

with said punch having a pair of bulges adjacent two edges of said fourth side, and with said form block having recesses along two sides of said sloped surface in complementary relation to said bulges, the step of forcing said punch into said blank to further draw said blank comprising the additional step of drawing said blank between each of said bulges and recesses to form swales in the blank at each side of said sloped surface.

2. The method of claim 1, wherein:

the step of forcing said punch into said blank to further draw said blank comprises ironing said blank between said sloped surface on said form block and a sloped surface at said fourth side of said punch generally matching said sloped surface on said form block.

3. The method of claim 1, wherein:

a double acting press is used to force said punch into said blank; and the step of holding said blank against said draw ring includes adjusting the holding force to permit deep draw action on the blank at said three sides of said punch, while an air draw is made at the portion of the blank not in contact with the punch at said fourth side.

4. A method for making an air draw of a sloped surface in sheet metal, comprising the steps of:

placing a metal blank on top of a draw ring;

holding said blank against the draw ring along a marginal portion of said blank;

forcing a multi-sided punch into said blank to draw said blank through said draw ring, with a first portion of the blank not in contact with a first side of said punch so that wrinkles are allowed to form in said first portion as said punch is forced through the draw ring, while a remaining second portion of said blank is in contact with the remaining sides of said punch, said first portion of the blank forming a sloped surface as the punch is forced into the blank;

contacting said first portion of the blank against a form block near the end of the draw, said form block having a sloped surface; and forcing said punch into said blank to further draw said blank into said form block, thereupon removing any wrinkles formed in the first portion of the blank as the blank was drawn into the draw ring;

with said punch having bulges adjacent two edges of said first side of the punch, and with said form block having recesses along two sides of said sloped surface in complementary relation to said bulges, the step of forcing said punch into said blank to further draw said blank further comprising the step of drawing said blank between each of said bulges and recesses to form swales in the blank at each side of said first portion.

5. The method of claim 4, wherein:

the step of forcing said punch into said blank to further draw said blank comprises ironing said blank between said sloped surface on said form block and a sloped surface at said first side of said punch generally matching said sloped surface on said form block.

6. The method of claim 5 wherein:

the step of holding said blank against said draw ring includes adjusting the holding force to permit deep draw action on the blank at said remaining sides of said punch, while an air draw is made on the first portion of the blank at said first side of the punch.

* * * * *